US005373783A

United States Patent [19]

Perry et al.

[11] Patent Number: 5,373,783

[45] Date of Patent: Dec. 20, 1994

[54] SPARK PLUG PRINTING MACHINE

[75] Inventors: John R. Perry, Daventry; Brian K. Allen, Rugby, both of England

[73] Assignee: Smiths Industries Public Limited Company, London, England

[21] Appl. No.: 231,775

[22] Filed: Apr. 25, 1994

[30] Foreign Application Priority Data

May 15, 1993 [GB] United Kingdom ..... 9310056

[51] Int. Cl.[5] ..... B41F 17/08

[52] U.S. Cl. ..... 101/38.1; 101/151

[58] Field of Search ..... 101/35, 38.1, 39, 40, 101/41, 44, 150, 163, 114, 115, 126, 129, 151

[56] References Cited

U.S. PATENT DOCUMENTS

| | | | |
|---|---|---|---|
| 1,892,545 | 12/1932 | Ward | 101/40 |
| 2,562,168 | 7/1951 | Blanchette | 101/40 |
| 2,737,886 | 3/1956 | Ruppel | 101/40 |
| 3,255,695 | 6/1966 | Johnson et al. | 101/211 |
| 3,593,661 | 7/1971 | Tripp | 101/40 |
| 4,640,188 | 2/1987 | Cosson et al. | 101/39 |
| 4,945,827 | 8/1990 | Audi et al. | 101/35 |

*Primary Examiner*—Ren Yan

*Attorney, Agent, or Firm*—Pollock, VandeSande and Priddy

[57] ABSTRACT

A spark plug printing machine has two silk screens with different color inks mounted side-by-side and facing down. Spark plug insulators are rotatably mounted in a vertical orientation on a turntable. A print transfer pad located beneath the screens is rotatable from a first position, where it is horizontal and contacts the screens, to a second vertical position. In the second position the pad contacts one of the insulators and is displaced along its length to roll the insulator along the pad through more than 360° so that ink from both screens is transferred to the insulator one after the other.

9 Claims, 3 Drawing Sheets

SPARK PLUG PRINTING MACHINE

BACKGROUND OF THE INVENTION

This invention relates to spark plug printing machines

Spark plugs are usually marked to indicate the manufacturer, type and so on by printing on the insulator body between the two electrodes. One example of a machine by which this printing can be carried out is described in U.S. Pat. No. 4640188. The machine described in this patent specification can be used only for printing in a single color. There are several problems in printing in more than one color, such as, for example, ensuring accurate registration of the colors on a curved surface and of being able to carry out the printing at sufficiently high speeds to be economical. To date, no one has been able to provide a satisfactory machine capable of printing spark plug insulators reliably in more than one color.

BRIEF SUMMARY OF THE INVENTION

It is an object of the present invention to provide a machine capable of printing spark plug insulators in more than one color.

According to one aspect of the present invention there is provided a spark plug printing machine including first and second printing screens arranged side-by-side and each having a different color ink, a print transfer pad that is displaceable from a first position in which it extends parallel to the two screens so that ink from both screens can be transferred to the pad to a different second position, and a support member for rotatably supporting the spark plug insulator with its axis parallel to the pad in its second position so that the insulator can be rolled along the length of the pad and both the inks transferred to the insulator one after the other during rotation of the insulator through more than 360°.

The printing screens are preferably mounted horizontally and facing downwardly. The insulator may be mounted vertically on a turntable adapted to support several insulators. The pad is preferably displaceable along its length in the second position so that the insulator is rolled along the pad by displacing the pad along its length. The ink may be a heat-flowable ink, the machine including means for heating the screens to maintain the ink flowable. The print transfer pad may be rotatably mounted about the axis, the pad being displaceable from the first position to the second position by rotating the pad about the axis.

According to another aspect of the present invention there is provided a spark plug printed on a machine according to the above one aspect of the invention.

A spark plug printing machine in accordance with the present invention will now be described, by way of example, with reference to the accompanying drawings.

DETAILED DESCRIPTION OF THE PREFERRED EMBODIMENT

Figure 1:
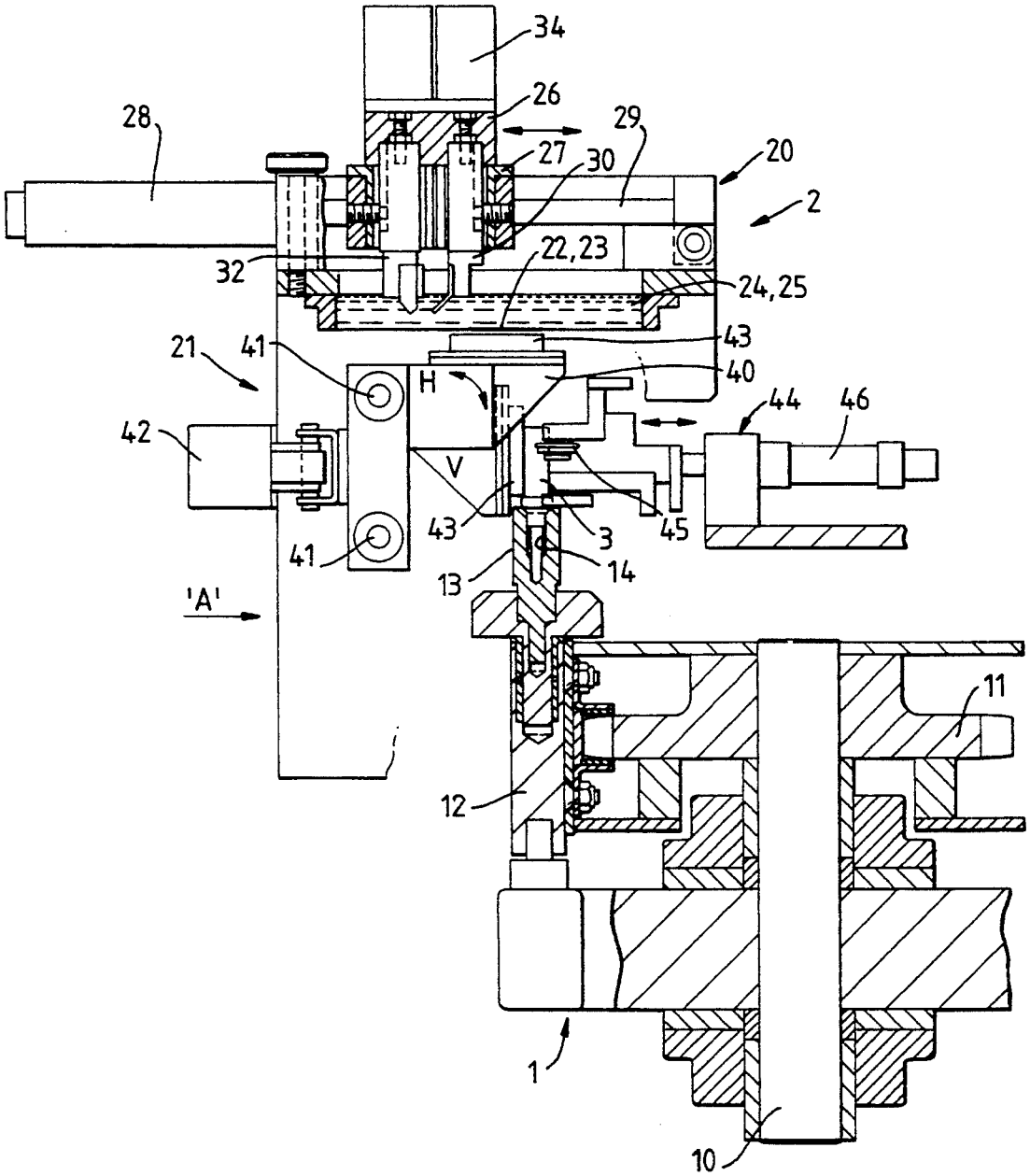
FIG. 1 is a partly sectional side elevation view of the machine.
Figure 2:
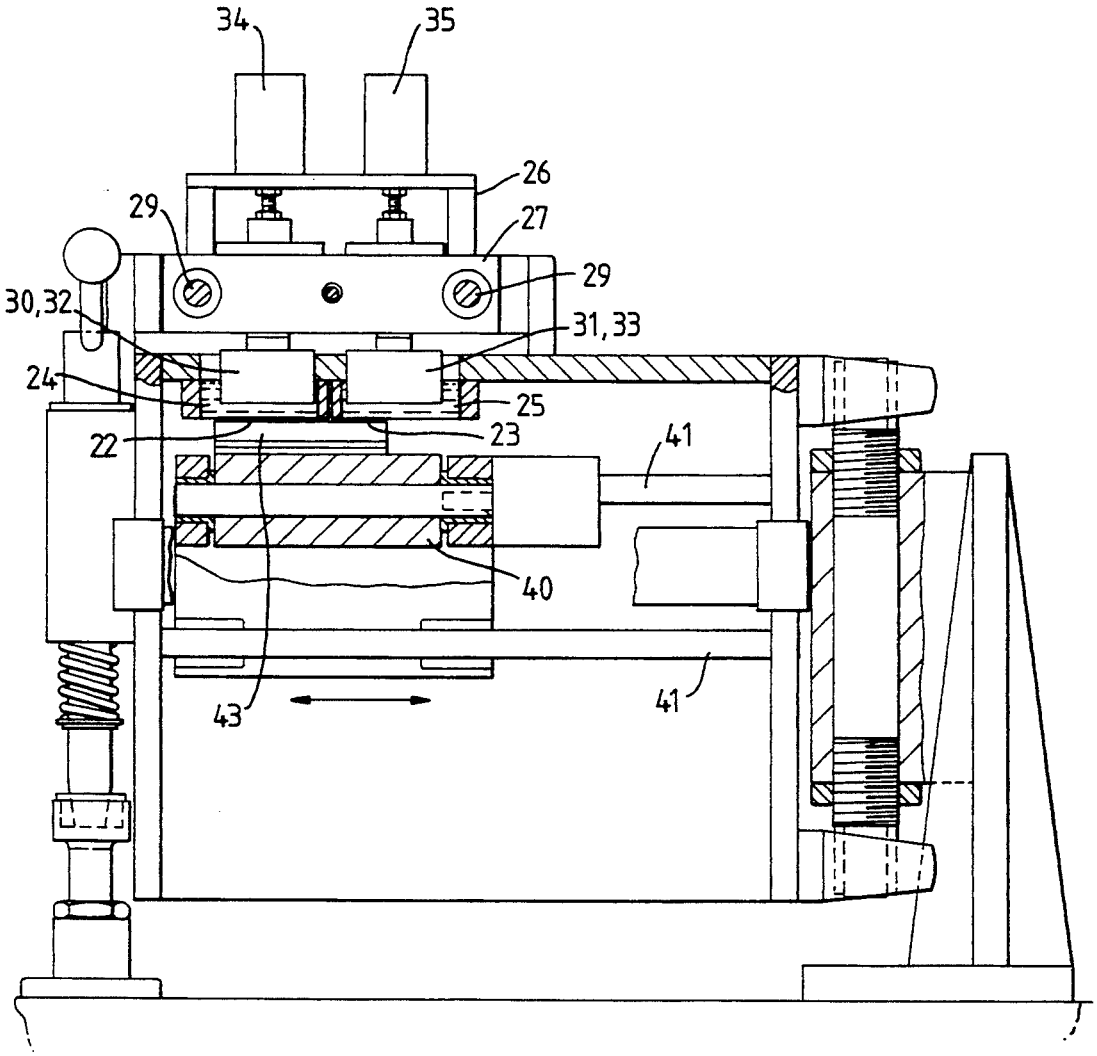
FIG. 2 is a partly sectional side elevation view along the arrow A of FIG. 1.

Referring first to FIGS. 1 and 2, the machine comprises a turntable assembly 1 and a printing head assembly 2. The turntable assembly 1 is used to support several spark plug insulators 3 (only one being shown in the drawings) during the printing operation, the turntable assembly being used to transfer the insulators between two conveyors (not shown).

The turntable assembly 1 has a vertical axle 10 and a horizontal turntable 11 with several stations 12 about its circumference at which the insulators are supported. Each station 12 has a vertically-extending cup 13 with a recess 14 in which the lower part of the insulator 3 is retained. The cup 13 is rotatable about a vertical axis so that the insulator 3 is also rotatable about this axis.

The printing head assembly 2 comprises a screen assembly 20 and a print transfer assembly 21 the purpose of which is to transfer print from the screen assembly to the insulators 3.

The screen assembly 20 has two separate silk screens 22 and 23, or similar printing screens, which have ink-permeable and ink-impermeable regions defining the pattern to be printed, so that an article can be printed by placing it against one side of the screen and forcing ink through the screen from the other side. The screens 22 and 23 are mounted horizontally with their printing surface facing down and with ink being applied to their upper surfaces. The spacing between the two screens is adjustable to allow for use with insulators of different diameters. In the present arrangement, the two screens are used for printing of two different colors such as red and black. Each screen 22 and 23 is contained in its own separate reservoir 24 and 25 that is heated and contains a supply of the appropriately colored, heat-flowable ink. Above the two screens is mounted an applicator mechanism 26 supported on a carriage 27. The carriage 27 is displaceable by an hydraulic pneumatic cylinder 28 along two parallel rails 29 extending along the length of the two screens 22 and 23. The applicator mechanism 26 has a pair of flood coat assemblies 30 and 31 and squeegee assemblies 32 and 33 mounted above respective ones of the screens 22 and 23. The assemblies 30 to 33 are also displaceable vertically up and down on the carriage 27 by means of hydraulic cylinders 34 and 35.

In operation, the applicator mechanism 26 is moved from left to right as, shown in FIG. 1, and the flood coat and squeegee assemblies 30 to 33 are brought down to contact the screens 22 and 23 by means of the cylinders 34 and 35. The flood coat assemblies 30 and 31 are mounted to the right so that they come into contact with the respective screen 22 or 23 first, to spread a relatively thick layer of ink onto the upper surface of the screens; this is then forced through the thickness of the screens by the stiffer squeegee assemblies 32 and 33. When the assemblies 30 to 33 have moved over the screens 22 and 23 they are lifted by appropriately actuating the cylinders 34 and 35, so that the carriage 27 can be pulled back to the left and the process repeated.

The print transfer assembly 21 is mounted beneath the screen assembly 20 and to one side of the insulator 3. The print transfer assembly 21 comprises a transfer head 40 mounted on two horizontal rails 41 extending at fight angles to the rails 29 and parallel to the length of the two screens 22 and 23. The rails 41 and transfer head 40 can also be moved horizontally at right angles to the rails 41 by means of a horizontally disposed hydraulic cylinder 42 so that it can be moved from left to right in FIG. 1. The transfer head 40 is mounted for rotational movement through 90° about a horizontal axis concentric with the upper one of the rails 41. The transfer head 40 has a pad 43 of a resilient material suitable for taking up and transferring ink. In one position (H) of the head 40, the pad 43 is oriented horizontally and is disposed beneath and in contact with the lower surface of the screens 22 and 23. The pad 43 includes a heater for preventing the ink drying. As shown in FIG. 2, the length of the pad 43 is sufficient to extend along the printing regions of both screens. In the other position (V) of the head 40, the pad 43 is oriented vertically, that is, parallel to the axis of the insulator 3, and is disposed on the left and in contact with the insulator 3. The insulator 3 is supported on its opposite, right-hand side by a backing unit 44 having two small wheels 45 (only one of which is shown) engaging the right-hand side of the insulator and movable towards or away from the insulator 3 by means of a horizontal hydraulic cylinder 46.

Figure 3:
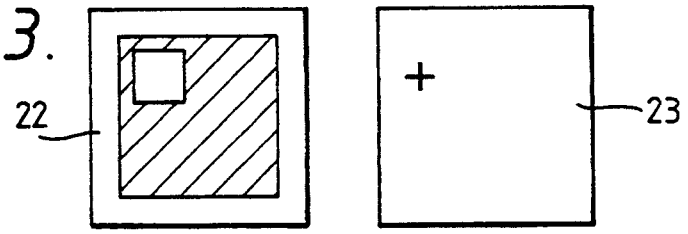
FIG. 3 is a view of the screens in the machine, from below.
Figure 4:
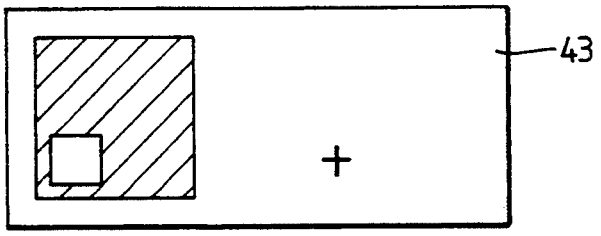
FIG. 4 is a view of the print transfer pad.
Figure 5:
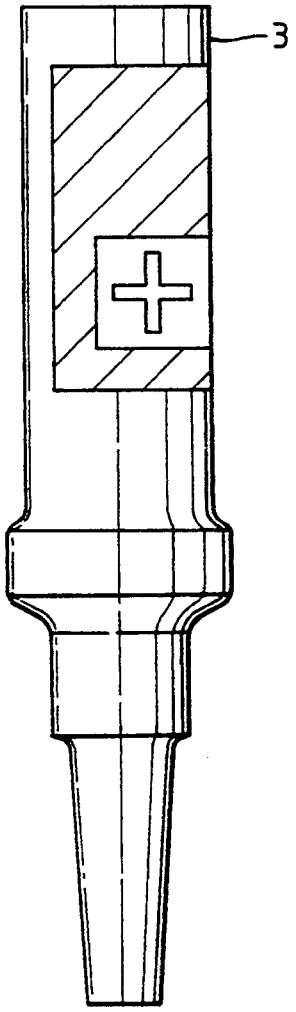
FIG. 5 shows a spark plug insulator after printing.

In operation, the two screens 22 and 23 are inked in the manner described above to produce two separate patterns in the different color inks, such as of the kind shown in FIG. 3. The print transfer head 40 is then swung up to position (H) so that the pad 43 is brought into contact with the screens 22 and 23 and thereby takes up ink from the two screens in a single operation. The transfer head 40 is then swung down to position (V) so that the ink deposited on the pad 43, when viewed from the right, appears as in FIG. 4. The turntable 11 is then stepped around to bring the insulator 3 alongside the backing unit 44. The print transfer head 40 is then moved along the rails 41 from left to right as viewed in FIG. 2. As it does this, the pad 43 contacts the insulator 3 and rolls it along the length of the pad so that ink is transferred to the surface of the insulator. The length of the pad 43 is twice the circumference of the insulator so that ink is first deposited from the screen 23 and then, as the insulator is rolled by more than 360°, ink from the other screen 22 is deposited on the insulator. It can be seen, therefore, that, in this way, different color inks can be deposited on the same region around the insulator 3 to produce a composite pattern as shown in FIG. 4. In order to avoid mixing, it will be appreciated that the two patterns will be chosen so that colored regions do not overlap one another, one pattern including blank areas in which colored regions of the other pattern are printed. After the pad 43 has been moved along the insulator 3, the transfer head 40 is retracted to the left so that the turntable 11 can be stepped around, moving the printed insulator out of the print station and bringing the next insulator into position for printing. The ink rapidly dries and cures when deposited on the unheated insulators; they can, therefore, be subsequently handled without risk that the printing will be damaged. It will be appreciated that the machine could be easily adapted to print in three different colors by using three separate screens.

The machine of the present invention enables multicolor printing onto spark plug insulators with high accuracy and good registration because the different colors are deposited in a single operation. This also enables the printing operation to be carried out at high speed.

It is not essential for the insulator to be rotated through two complete revolutions if the printed matter in either color does not extend around the complete circumference of the insulators. The insulators could be mounted horizontally and the transfer pad displaced through 180° so that it also extends horizontally.

What we claim is:

1. A spark plug printing machine comprising: a first printing screen having a first ink; a second printing screen having a second ink of a different color from the first ink; means mounting the first and second screens side-by-side; a print transfer pad having a length and a surface; means mounting the print transfer pad for displacement from a first position in which the surface of the pad extends parallel to the two screens so that ink from both screens is transferred to the pad, to a second position; a support member, the support member rotatably supporting a spark plug insulator with the axis of the insulator parallel to the surface of the pad in its second position; and means for rolling the insulator along the length of the pad so that ink from both screens is transferred to the insulator one after the other during rotation of the insulator through more than 360°.

2. A machine according to claim 1, wherein the printing screens are mounted horizontally.

3. A machine according to claim 2, wherein the printing screens face downwardly.

4. A machine according to claims 1, wherein the insulator is mounted vertically.

5. A machine according to claim 4 including a turnable adapted to support several insulators, and wherein the insulator is mounted on the turntable.

6. A machine according to claim 1, wherein the means for rolling the insulator along the length of the pad is means for displacing the pad along its length in the second position so that the insulator is rolled along the pad by displacing the pad along its length.

7. A machine according to claim 1, wherein the ink is a heat-flowable ink, and wherein the machine includes means for heating the screens and the pad to maintain the ink flowable.

8. A machine according to claim 1, wherein the means mounting the print transfer pad mounts the pad rotatably about an axis, and wherein the pad is displaceable from the first position to the second position by rotating the pad about the axis.

9. A spark plug printing machine comprising: a first printing screen having a first ink; a second printing screen having a second ink of a different color from the first ink; means mounting the first and second screens side-by-side horizontally and facing down; a print transfer pad having a length and a surface; means rotatably mounting the print transfer pad for displacement from a first position in which the surface of the pad extends horizontal and parallel to the two screens so that ink from both screens is transferred to the pad, to a second vertical position; a support member, the support member rotatably supporting a spark plug insulator with the axis of the insulator vertical and parallel to the surface of the pad in its second position; and means for displacing the pad along its length in the second position so that the insulator is rolled along the length of the pad and ink from both screens is transferred to the insulator one after the other during rotation of the insulator through more than 360°

* * * * *